US011378315B2

(12) United States Patent
Lee et al.

(10) Patent No.: US 11,378,315 B2
(45) Date of Patent: Jul. 5, 2022

(54) AIR CONDITIONER SYSTEM INCLUDING REFRIGERANT CYCLE CIRCUIT FOR OIL FLOW BLOCKING

(71) Applicant: SAMSUNG ELECTRONICS CO., LTD., Suwon-si (KR)

(72) Inventors: Donggyu Lee, Suwon-si (KR); Kyoungrock Kim, Suwon-si (KR); Kyunghoon Kim, Suwon-si (KR); Joonho Yoon, Suwon-si (KR); Byunghan Lim, Suwon-si (KR); Dongsik Jin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 96 days.

(21) Appl. No.: 16/778,958

(22) Filed: Jan. 31, 2020

(65) Prior Publication Data

US 2020/0256595 A1 Aug. 13, 2020

(30) Foreign Application Priority Data

Feb. 7, 2019 (KR) ..... 10-2019-0014527

(51) Int. Cl.
*F25B 43/02* (2006.01)
*F25B 13/00* (2006.01)
(Continued)

(52) U.S. Cl.
CPC ..... *F25B 49/02* (2013.01); *F25B 13/00* (2013.01); *F25B 31/004* (2013.01); *F25B 41/20* (2021.01);
(Continued)

(58) Field of Classification Search
CPC ..... F25B 13/00; F25B 31/004; F25B 2313/02741; F25B 2400/051;
(Continued)

(56) References Cited

U.S. PATENT DOCUMENTS 4,942,743 A * 7/1990 Gregory ..... F25B 13/00 62/503
5,369,958 A * 12/1994 Kasai ..... F24F 3/065 62/158
(Continued)

FOREIGN PATENT DOCUMENTS

CN 1643306 A 7/2005
CN 201666696 U 12/2010
(Continued)

OTHER PUBLICATIONS

JP 09159295 (English Translation) (Year: 1997).*
(Continued)

*Primary Examiner* — Jonathan Bradford
(74) *Attorney, Agent, or Firm* — Staas & Halsey LLP

(57) ABSTRACT

An air conditioner system is disclosed. The air conditioner system includes: a compressor; a four-way valve configured to provide a refrigerant circulation path depending on an operation mode of the air conditioner system; a blocking valve disposed between the compressor and the four-way valve; a circulation line configured to provide a path for introducing a refrigerant discharged from the compressor back into the compressor, when the blocking valve is in a closed state; and a controller configured to control the blocking valve based on a pressure of the refrigerant discharged from the compressor.

12 Claims, 8 Drawing Sheets

(51) Int. Cl.

| | |
|---|---|
| ***F25B 49/02*** | (2006.01) |
| ***F25B 31/00*** | (2006.01) |
| ***F25B 41/20*** | (2021.01) |
| ***F25B 41/24*** | (2021.01) |

(52) U.S. Cl.
CPC .... *F25B 41/24* (2021.01); *F25B 2313/02741* (2013.01); *F25B 2400/23* (2013.01); *F25B 2500/16* (2013.01); *F25B 2600/0253* (2013.01); *F25B 2600/2519* (2013.01); *F25B 2700/1931* (2013.01); *F25B 2700/21152* (2013.01)

(58) Field of Classification Search
CPC ..... F25B 2400/23; F25B 2500/16; F25B 2600/0253; F25B 2600/2519; F25B 2700/1931; F25B 2700/21152
See application file for complete search history.

(56) References Cited

U.S. PATENT DOCUMENTS

| | | | | |
|---|---|---|---|---|
| 2007/0289723 | A1* | 12/2007 | Koster | F25B 40/00 165/145 |
| 2009/0165484 | A1* | 7/2009 | Matsui | F24F 3/1429 62/271 |
| 2010/0281894 | A1 | 11/2010 | Huff | |

FOREIGN PATENT DOCUMENTS

| | | | |
|---|---|---|---|
| CN | 104089347 | A | 10/2014 |
| CN | 105444448 | A | 3/2016 |
| CN | 206847112 | U | 1/2018 |
| EP | 1496317 | A1 | 2/2003 |
| EP | 3 246 637 | A1 | 11/2017 |
| JP | 9-159295 | A | 6/1997 |
| JP | 2000-329432 | | 11/2000 |
| KR | 2000-0038556 | | 7/2000 |
| KR | 10-0590653 | | 12/2005 |
| KR | 10-1314270 | | 10/2013 |
| KR | 10-1636512 | | 7/2016 |

OTHER PUBLICATIONS

CN 105444448 (English Translation) (Year: 2018).*
CN 104089347 (Englisth Translation) (Year: 2014).*
European Office Action dated May 26, 2020, in corresponding European Patent Application No. 20154709.8.
Extended European Search Report dated Aug. 28, 2020, in corresponding European Patent Application No. 20154709.8.
Office Action dated Feb. 2, 2021 in corresponding Chinese Patent Application 202010082255.2.
Office Action dated Jul. 27, 2021, in Chinese Patent Application No. 202010082255.2.
Office Action dated Dec. 7, 2021 for Chinese Patent Application No. 202010082255.2.
Examination Report dated Feb. 9, 2022 for European Patent Application No. 20154709.8.

* cited by examiner

AIR CONDITIONER SYSTEM INCLUDING REFRIGERANT CYCLE CIRCUIT FOR OIL FLOW BLOCKING

CROSS-REFERENCE TO RELATED APPLICATION(S)

This application is based on and claims priority under 35 U.S.C. § 119 to Korean Patent Application No. 10-2019-0014527, filed on Feb. 7, 2019, in the Korean Intellectual Property Office, the disclosure of which is incorporated by reference herein in its entirety.

BACKGROUND

Field

Apparatuses and methods consistent with the disclosure relate to an air conditioner system, and more particularly, to an air conditioner system capable of minimizing an amount in which oil used for preventing damage to a compressor flows entirely through a cycle circuit.

Description of the Related Art

In a general air conditioner system, oil is required to prevent damage to a compressor. However, it was often that the oil was mixed with a refrigerant to be discharged from the compressor and the refrigerant was discharged together with the oil.

In order to solve the problem, an oil separator has conventionally been installed near an outlet of the compressor to separate only oil from the refrigerant discharged from the compressor and collect the oil back. However, when an ambient temperature is low, the oil separator has significantly low efficiency in separating the refrigerant and the oil from each other, and thereby, the refrigerant circulates still together with a large amount of oil mixed therewith along a cycle circuit even after passing through the oil separator.

In particular, in an air conditioner system for a building, a factory, or the like, the refrigerant usually circulates through connecting pipes of 300 m or more. If the oil discharged from the compressor is mixed with the refrigerant even after passing through the oil separator, it will take a long time for the oil circulating together with the refrigerant to return back to the compressor through all the connecting pipes.

Consequently, it has been required to inject additional oil to prevent damage to the compressor. However, the additionally injected oil increases a thermal resistance and reduces energy efficiency by, for example, being applied onto a wall surface of a heat exchanger (evaporator) tube, which has a relatively low pressure. Also, the injection of the additional oil causes an increase in material costs.

SUMMARY

According to an embodiment of the disclosure, an air conditioner system includes: a compressor; a four-way valve configured to provide a refrigerant circulation path depending on an operation mode of the air conditioner system; a blocking valve disposed between the compressor and the four-way valve; a circulation line configured to provide a path for introducing a refrigerant discharged from the compressor back into the compressor, when the blocking valve is in a closed state; and a controller configured to control the blocking valve based on a pressure of the refrigerant discharged from the compressor.

BRIEF DESCRIPTION OF THE DRAWINGS

The above and/or other aspects of the disclosure will be more apparent by describing certain embodiments of the disclosure with reference to the accompanying drawings, in which.

DETAILED DESCRIPTION

Figure 1:
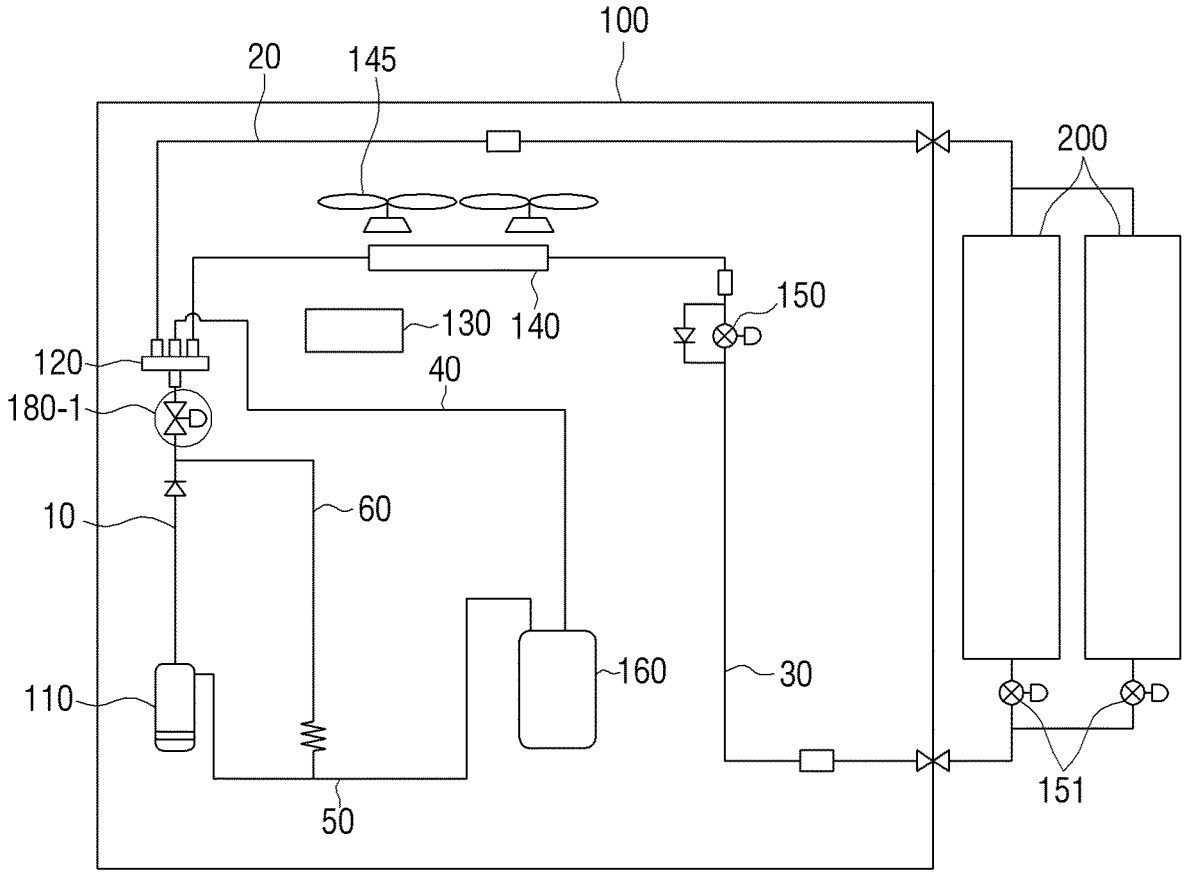
FIG. 1 is a diagram illustrating a cycle circuit for an air conditioner system including a blocking valve according to an embodiment of the disclosure.

The disclosure provides an air conditioner system capable of blocking a refrigerant discharged from a compressor not to immediately flow into a heat exchanger or an indoor unit, when the refrigerant discharged from the compressor contains a large amount of oil.

In addition, the disclosure provides an air conditioner system capable of blocking a refrigerant having passed through the compressor and an oil separator not to immediately flow into the heat exchanger or the indoor unit, when separation efficiency of the oil separator is not good.

Ultimately, the disclosure provides an air conditioner system capable of minimizing additional injection of the refrigerant and the resultant deterioration in energy efficiency through the above-described process.

Before specifically describing the disclosure, a method for demonstrating the specification and drawings will be described.

First of all, the terms used in the specification and the claims are general terms selected in consideration of the functions in the various embodiments of the disclosure. However, these terms may vary depending on intentions of those skilled in the art, legal or technical interpretation, emergence of new technologies, and the like. Also, there may be some terms arbitrarily selected by the applicant. These terms may be construed as meanings defined in the specification and, unless explicitly defined, may be construed based on the entire contents of the specification and the common technical knowledge in the art.

Also, the same reference numerals or symbols described in each of the drawings attached to the specification denote parts or elements that perform substantially the same functions. For convenience of description and understanding, different embodiments will be described using the same reference numerals or symbols. That is, although elements having the same reference numerals are all illustrated in a plurality of drawings, the plurality of drawings do not mean one embodiment.

Also, in the specification and the claims, terms including ordinal numbers such as "first" and "second" may be used to distinguish the elements from each other. These ordinals are used to distinguish identical or similar elements from each other, and the use of such ordinals should not be understood as limiting the meanings of the terms. For example, elements combined with such ordinal numbers should not be limited in their use order, arrangement order, or the like by the numbers. If necessary, the ordinal numbers may be used interchangeably with each other.

In the specification, the singular expression includes the plural expression unless the context clearly indicates otherwise. In the application, the term "include" or "comprise" indicates the presence of features, numbers, steps, operations, elements, parts, or combinations thereof written in the specification, but do not preclude the presence or addition of one or more other features, numbers, steps, operations, elements, parts, or combinations thereof.

In the embodiments of the disclosure, the term "module", "unit", "part", or the like refers to an element that performs at least one function or operation. The element may be implemented with hardware, software, or a combination of hardware and software. In addition, a plurality of "modules", "units", "parts", or the like may be integrated into at least one module or chip and implemented by at least one processor, excluding the case where each of the plurality of "modules", "units", "parts", or the like should necessarily be implemented with individual specific hardware.

Also, in the embodiments of the disclosure, when any part is described as being connected to another part, this includes not only a direct connection but also an indirect connection through another medium. When a certain part includes a certain element, unless explicitly described otherwise, this means that another element may be additionally included, rather than excluding another element.

In the embodiments of the disclosure, the meaning of "at least one of configuration 1, configuration 2 or configuration 3" may include "only configuration 1", "only configuration 2", "only configuration 3", "both configuration 1 and configuration 2", "both configuration 2 and configuration 3", "both configuration 1 and configuration 3", or "all of configuration 1, configuration 2, and configuration 3".

FIG. 1 is a diagram illustrating a cycle circuit for an air conditioner system 100 including a blocking valve according to an embodiment of the disclosure. The air conditioning system 100 is a system installed in any of the various places such as homes, buildings, and factories, to control a temperature in the facility.

Referring to FIG. 1, the air conditioner system 100 is connected to a plurality of indoor units 200 connected to cooling expansion valves 151, and may include a compressor 110, a four-way valve 120, a controller 130, a heat exchanger 140, a heating expansion valve 150, and a liquid separator 160. In addition, the air conditioner system 100 may include pipe lines 10, 20, 30, 40, 50, and 60, each for connecting the above-described components to one another.

Meanwhile, although the air conditioner system 100 is illustrated through FIG. 1 as a component separate from the cooling expansion valve 151 and the indoor units 200, the cooling expansion valve 151 and the indoor units 200 may be implemented as part of the air conditioner system 100.

The compressor 110 is a component for compressing a refrigerant, which is generally a gas. In order to prevent a situation in which a metal part or the like of the compressor 110 is damaged in the process of compressing the refrigerant, the compressor 110 may be enclosed with oil therein.

The four-way valve 120 is a component for controlling a refrigerant circulation path depending on an operation mode (cooling mode or heating mode) of the air conditioner system 100.

As an example, when the air conditioner system 100 operates in the heating mode, the four-way valve 120 may set a refrigerant path such that the refrigerant discharged from the compressor 110 and introduced into the four-way valve 120 via the line 10 may circulate through the indoor unit 200 via the line 20 to the heat exchanger 140, and then through the four-way valve 120 back via the line 30, and finally through the liquid separator 160 via the line 40 to the compressor 110.

When the air conditioner system 100 operates in the cooling mode in reverse, the four-way valve 120 may set a refrigerant path such that the refrigerant discharged from the compressor 110 and introduced into the four-way valve 120 via the line 10 may circulate through the heat exchanger 140 via the line 30 to the indoor unit 200, and then through the four-way valve 120 back via the line 20, and finally through the liquid separator 160 via the line 40 to the compressor 110.

To do so, the four-way valve 120 may include separate valves and/or internal pipe lines therein. The above-described operations of the four-way valve 120 may be electronically controlled by the controller 130. Specifically, when the controller 130 transmits a switching signal corresponding to the operation mode to the four-way valve 120, the four-way valve 120 may control a refrigerant path based on the operation mode corresponding to the received switching signal.

The controller 130 may control overall operations of the air conditioner system 100. Specifically, the controller 130 may electronically control each of the components included in the air conditioner system 100.

To do so, the controller 130 may include a processor (not shown) including a circuit and/or at least one software module. The processor may include a random access memory (RAM) (not shown), a read only memory (ROM) (not shown), a central processing unit (CPU) (not shown), a graphic processing unit (GPU) (not shown), a system bus (not shown), and the like.

The controller 130 may be a single integrated control unit controlling all the components of the air conditioner system 100, but refer to all or at least one of a plurality of control units connected to each other to control respective areas of the air conditioner system 100.

The controller 130 may control the components for changing a state of the refrigerant, such as the compressor 110 and the heat exchanger 140, but may also electronically control various valves, including the four-way valve 120, installed in the respective lines.

The heat exchanger 140 is a component operating as an evaporator for the refrigerant in the heating mode and as a condenser for the refrigerant in the cooling mode. According to a change in a state of the refrigerant in the heat exchanger 140, heat is exchanged by a fan 145 between air and the refrigerant passing through the heat exchanger 140.

The heating expansion valve 150 is a component for expanding the refrigerant in the heating mode before the liquid-state refrigerant is evaporated.

The liquid separator 160 is a component for separating the liquid-state refrigerant that has not been vaporized after the refrigerant passes through the heat exchanger 140 or the indoor unit 200, so as to only provide the gas-state refrigerant to the compressor 110. To do so, the liquid separator 160 may be disposed between the four-way valve 120 and an inlet port of the compressor 110.

The indoor unit 200 is a component for providing cool air in the cooling mode and warm air in the heating mode, and may evaporate the refrigerant in the cooling mode and condense the refrigerant in the heating mode. The indoor unit 200 may separately include a fan, a motor, and the like for circulating air for exchange between the refrigerant and the air.

Although the indoor unit 200 is illustrated in FIG. 1 as being installed in only one block, the indoor unit 200 may, of course, include a plurality of indoor units by installing one or more indoor units on each floor or in each area according to the facility scale of the building/factory. If the facility with the air conditioner system 100 installed therein is a building or a factory on a certain-extent scale or greater, the refrigerant movement path may be several hundreds of meters or longer for the refrigerant discharged from the air conditioner system 100 to return back through the indoor unit 200.

In addition, referring to FIG. 1, the air conditioner system 100 according to an embodiment of the disclosure may include a blocking valve 180-1 disposed between the compressor 110 and the four-way valve 120. The air conditioner system 100 may also include a circulation line 60 for providing a (closed loop) path for introducing the refrigerant discharged from the compressor 110 back into the compressor 110.

The blocking valve 180-1 may block the refrigerant discharged from the compressor 110 not to reach the four-way valve 120, or may not do so.

The blocking valve 180-1 may be implemented as a solenoid valve to be electronically controlled, but is not limited thereto.

The controller 130 may control the blocking valve 180-1 based on a pressure of the refrigerant discharged from the compressor 110. Meanwhile, the controller 130 may close the blocking valve 180-1, once the air conditioner system 100 starts to operate.

The controller 130 may open the blocking valve 180-1, when a temperature of the compressor 110 is higher than a saturation temperature corresponding to the pressure of the refrigerant having been discharged from the compressor 110 by a predetermined value or more.

The saturation temperature refers to a temperature at which the refrigerant transitions to a liquid-gas state at the corresponding pressure. When the temperature of the compressor 110 is higher than the saturation temperature corresponding to the pressure of the refrigerant having been discharged from the compressor 110 by the predetermined value or more, it may be considered that the refrigerant and oil are physically separated at least to a certain extent in the compressor 110. Accordingly, the controller 130 may open the blocking valve 180-1 to transfer the refrigerant discharged from the compressor 110 to the four-way valve 120.

Figure 2:
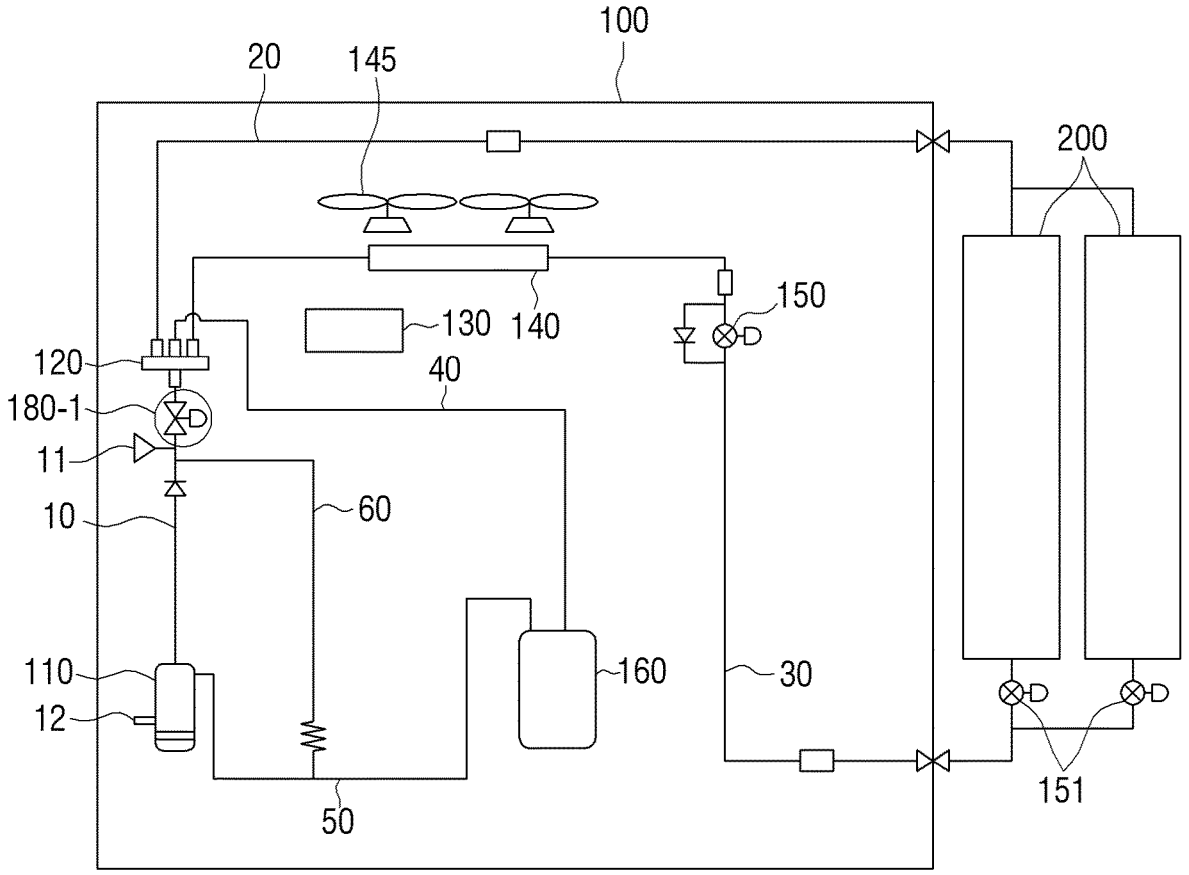
FIG. 2 is a diagram for explaining an example of a condition for controlling the blocking valve.

In this regard, referring to FIG. 2, the controller 130 may identify a pressure of the refrigerant having been discharged from the compressor 110 using a pressure sensor 11, and may identify a temperature of the compressor 110 using a temperature sensor 12. In this case, the temperature sensor 12 may be installed on a surface of the compressor 110 to sense a temperature of the compressor 110.

For example, the controller 130 may open the blocking valve 180-1, when the temperature of the compressor 110 is 5° C. or more higher than the saturation temperature corresponding to the pressure of the refrigerant having been discharged from the compressor 110.

However, this is merely an example. The type, location, and predetermined value of each sensor are not limited thereto. Especially, the predetermined value may be set differently depending on the material constituting the compressor 110, the thickness of the compressor 110, the thickness or properties of each pipe, and the like.

Figure 3:
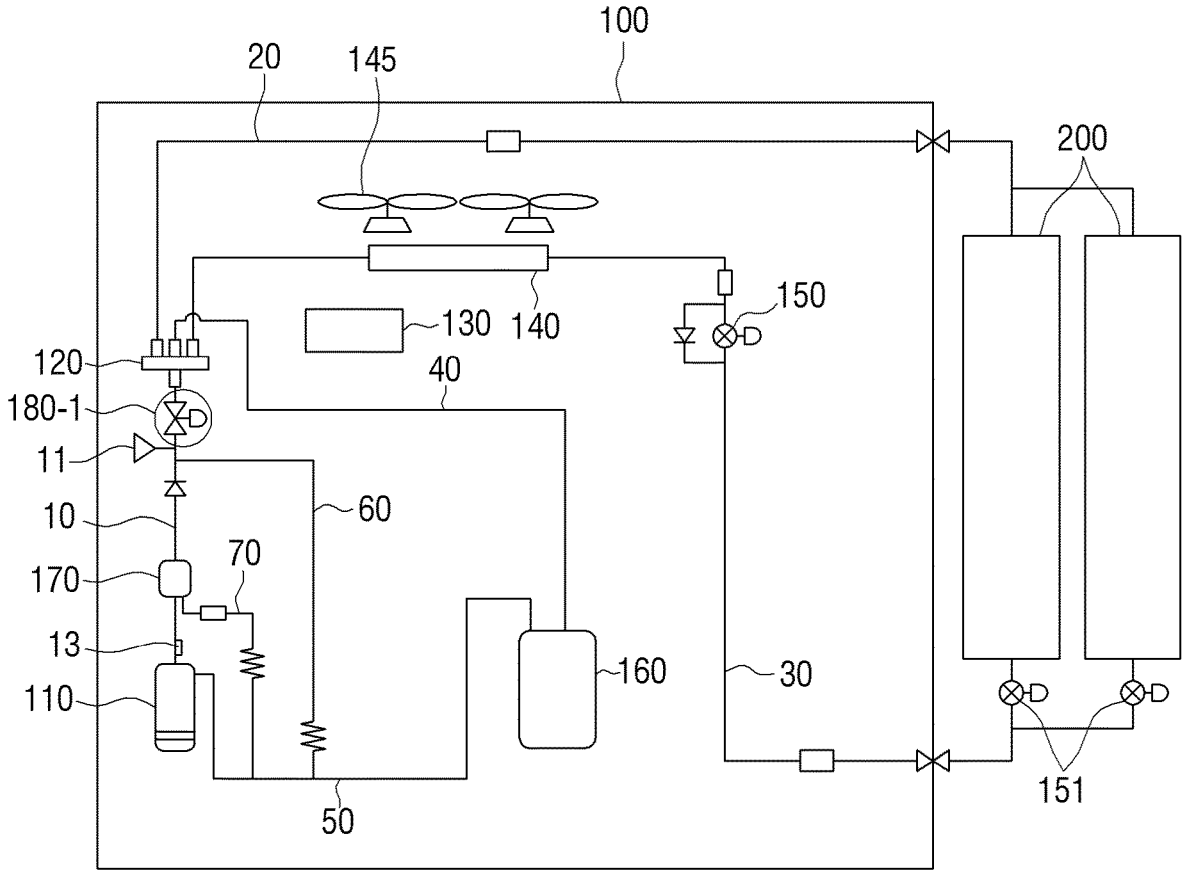
FIG. 3 is a diagram for explaining another example of a condition for controlling the blocking valve.

Meanwhile, referring to FIG. 3, the air conditioner system 100 may further include an oil separator 170 disposed between the compressor 110 and the four-way valve 120.

The oil separator 170 is a component for separating oil from the refrigerant discharged from the compressor 110 to be supplied to the four-way valve 120. The oil separated in the oil separator 170 may be introduced back into the compressor 110 via an oil return line 70.

At this time, the controller 130 may open the blocking valve 180-1, when a discharge temperature of the compressor 110 is higher than a saturation temperature corresponding to the pressure of the refrigerant having been discharged from the compressor 110 and having passed through the oil separator 170 by a predetermined value or more.

When a temperature of the refrigerant that is being discharged from the compressor 110, that is, the discharge temperature, is higher than the saturation temperature corresponding to the pressure of the refrigerant having been discharged from the compressor 110 and having passed through the oil separator 170 by the predetermined value or more, it may be considered that the separation efficiency of the oil separator 170 is at a certain-extent level or higher, and thus, the controller 130 may open the blocking valve 180-1.

In this regard, referring to FIG. 3, the controller 130 may identify the pressure of the refrigerant having been discharged from the compressor 110 (having passed through the oil separator 170) using the pressure sensor 11, and may identify the discharge temperature of the compressor 110 using a temperature sensor 13. In this case, the temperature sensor 13 may be installed on a surface of a pipe in which the refrigerant is being discharged from the compressor 110 flows so as to sense the discharge temperature of the compressor 110.

For example, the controller 130 may open the blocking valve 180-1, when the discharge temperature of the compressor 110 is 15° C. or more higher than the saturation temperature corresponding to the pressure of the refrigerant having been discharged from the compressor 110 (having passed through the oil separator 170).

However, this is merely an example. The type, location, and predetermined value of each sensor are not limited thereto. Especially, the predetermined value may be set differently depending on the material constituting the compressor 110, the thickness of the compressor 110, the thickness or properties of each pipe, and the like.

Figure 4:
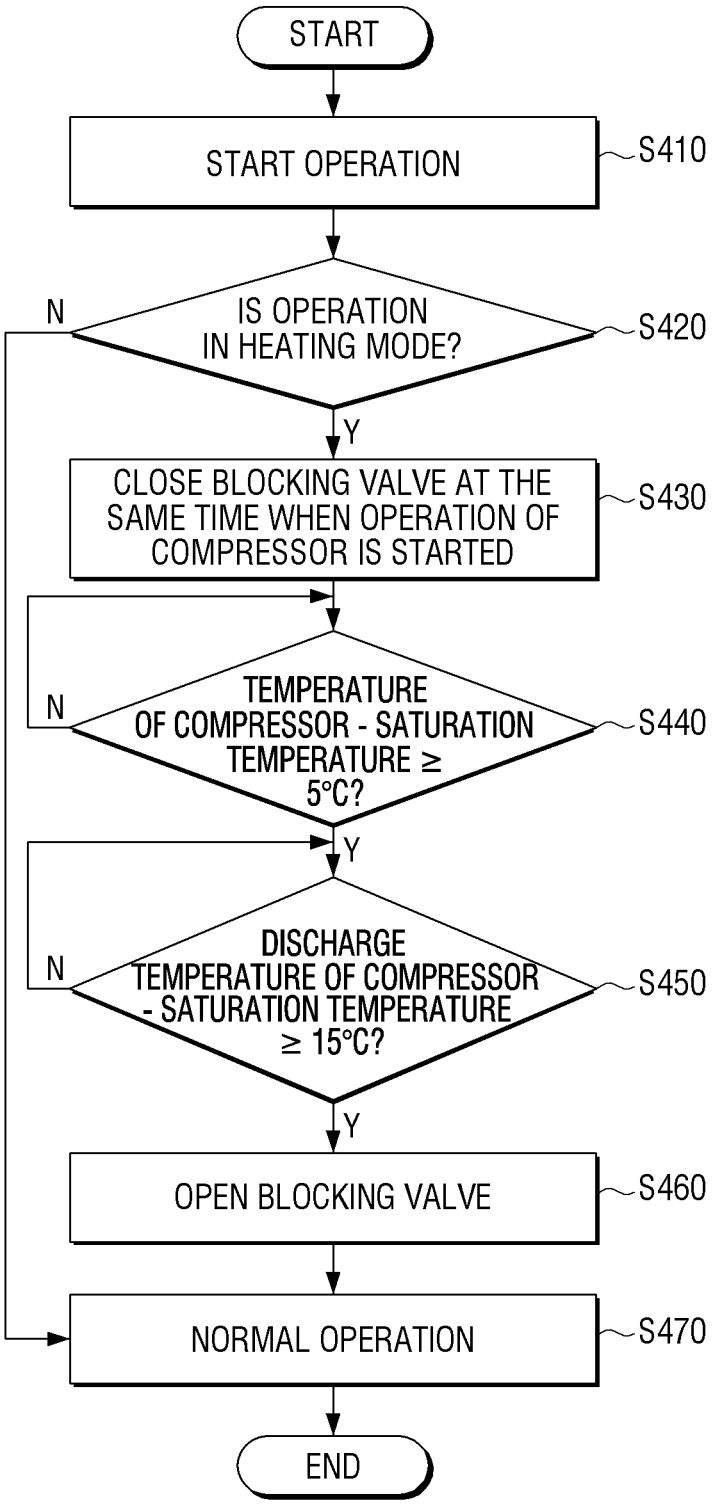
FIG. 4 illustrates an algorithm for explaining an operation of the air conditioner system for controlling the blocking valve according to an embodiment of the disclosure.

FIG. 4 illustrates an algorithm for explaining an operation of the air conditioner system 100 for controlling the blocking valve according to an embodiment of the disclosure.

Referring to FIG. 4, when the operation of the air conditioner system 100 is started (S410), the controller 130 may first identify whether the air conditioner system 100 operates in a heating mode.

When the air conditioner system 100 does not operate in the heating mode (S420—N), the controller 130 may perform a normal operation while opening the blocking valve 180-1 (S470). When the air conditioner system 100 operates is in the heating mode (S420—Y), however, the controller 130 may close the blocking valve 180-1 at the same time when the operation of the compressor 110 is started (S430).

In general, when an ambient temperature is low, it is highly likely that the refrigerant and the oil may be physically combined in the compressor 110, or the efficiency of the oil separator 170 may be low. It is thus necessary to close the blocking valve 180-1 upon the start of the heating-mode operation in a low temperature environment.

Meanwhile, in the algorithm of FIG. 4, the blocking valve 180-1 is closed at the same time when the operation of the compressor 110 is started (S430), but it may be sufficient if the blocking valve 180-1 is closed only within a predetermined time from the time when the operation of the compressor 110 is started.

In addition, in case that the four-way valve 120 includes valves for switching a refrigerant circulation path, and it is required to use a high-pressure environment, which is caused by the compressor 110 spouting the refrigerant, when switching the refrigerant circulation path to the heating-mode path, the step S430 of FIG. 4 may be slightly different. In this case, if the blocking valve 180-1 is closed at the same time when the operation of the compressor 110 is started, the four-way valve 120 may remain unable to switch the refrigerant path to be suitable for the heating mode.

In this case, the controller 130 may therefore close the blocking valve 180-1 after a predetermined time (e.g., 5 seconds) has elapsed since a switching signal for switching the four-way valve 120 to the heating mode is transmitted from the controller 130 to the four-way valve 120 even though the operation of the compressor 110 has already been started, rather than closing the blocking valve 180-1 at the same time when the operation of the compressor 110 is started. Specifically, the controller 130 may close the blocking valve 180-1 after a first predetermined time from the time when the switching signal is transmitted to the four-way valve 120 and within a second predetermined time from the time when the operation of the compressor 110 is started.

Referring back to the algorithm of FIG. 4, after closing the blocking valve 180-1 (S430), the controller 130 may identify whether the temperature of the compressor 110 is 5° C. or more higher than the saturation temperature corresponding to the pressure of the refrigerant having been discharged from the compressor 110.

Even if a difference between the temperature of the compressor 110 and the saturation temperature is smaller than 5° C. (S440—N), the temperature of the compressor 110 may increase over time due to the operation of the compressor 110.

When the temperature of the compressor 110 is 5° C. or more higher than the saturation temperature (S440—Y), the controller 130 may identify whether the discharge temperature of the compressor 110 is 15° C. or more higher than the saturation temperature (S450). Meanwhile, unlike FIG. 4, there may be only either step S440 or step S450, or steps S440 and S450 may be changed in terms of order.

When the discharge temperature of the compressor 110 is 15° C. or more higher than the saturation temperature (S450—Y), the controller 130 may open the blocking valve 180-1 and perform a normal operation (S470). At this time, the normal operation means that the refrigerant circulates a cycle circuit for the air conditioner system 100 and the indoor unit 200 depending on the operation mode without obstruction by the blocking valve 180-1.

Meanwhile, when the blocking valve 180-1 is opened after being closed for a while as in the above-described embodiments, the controller 130 may additionally perform some protection controls to prevent a problem that may occur as the blocking valve 180-1 is closed.

Figure 5:
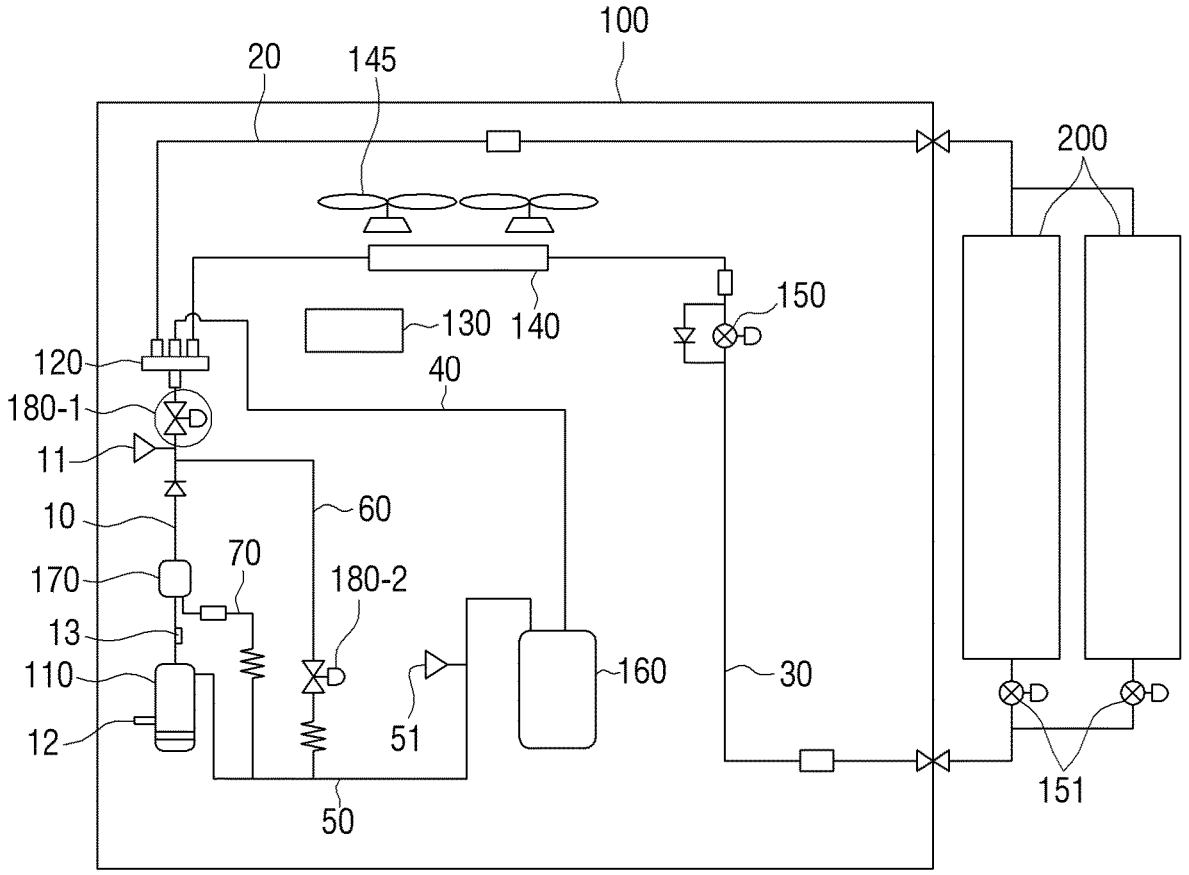
FIG. 5 is a diagram for explaining various examples in which the air conditioner system including the blocking valve performs protection controls.

In this regard, FIG. 5 illustrates a cycle circuit for explaining various examples of the protection controls of the air conditioner system 100 including the blocking valve 180-1.

Referring to FIG. 5, the controller 130 may open a valve 180-2 disposed in the circulation line 60, when an amount of the oil in an oil return line 70 for supplying the oil discharged from the oil separator 170 to the inlet port of the compressor is smaller than a predetermined amount and a pressure at the inlet port of the compressor 110 is lower than a predetermined pressure. This is to prevent damage to the compressor 110 due to an insufficient amount of oil at the inlet port of the compressor 110.

In this case, the amount of oil in the oil return line 70 may be identified by using an oil amount sensor (not shown) installed at an output of the oil separator 170 or an oil amount sensor (not shown) installed in the oil return line 70. In addition, the pressure at the inlet port of the compressor 110 may be sensed by using a pressure sensor 51.

As an example, the controller 130 may open the valve 180-2, when the pressure at the inlet port of the compressor 110 is 2.0 kgf/cm$^2$ in a state in which the amount of oil in the oil return line 70 is insufficient.

The controller 130 may also open the blocking valve 180-1 when the pressure at the inlet port of the compressor 110 is higher than the predetermined pressure. This is also to prevent damage to the compressor 110 by preventing the pressure at the inlet port of the compressor 110 from being extremely high as a result of repeated situations in which the refrigerant blocked by the closing of the blocking valve 180-1 is returned to the inlet port of the compressor 110 through the circulation line 60.

At this time, the pressure at the inlet port of the compressor 110 may be measured by the pressure sensor 51 of FIG. 5 or the like. The predetermined pressure may be an allowable maximum pressure for the (low-pressure side) inlet port of the compressor 110 or a value that is smaller than the allowable maximum pressure by a predetermined value.

In addition, the controller 130 may lower an operating frequency of the compressor 110, when a difference between the pressure of the refrigerant discharged from the compressor 110 and the pressure at the inlet port of the compressor 110 is greater than or equal to a predetermined value. At this time, the pressure of the (high-pressure side) refrigerant discharged from the compressor (110) may be measured by the pressure sensor 11, and the pressure at the (low-pressure side) inlet port of the compressor 110 may be measured by the pressure sensor 51.

This is a result of considering that the larger the difference in pressure between the high-pressure side and the low-pressure side, the greater the bypass noise due to the operation of the compressor 110. As an example, when the difference between the high-pressure side and the low-pressure side is greater than or equal to a predetermined value (15 kgf/cm$^2$), the controller 130 may reduce noise by lowering the operating frequency of the compressor 110.

The air conditioner system 100 necessarily needs to neither apply all of the three protection controls described above at the same time nor use only one of them. That is, the three protection controls described above may be each independently applied to the air conditioner system 100.

Figure 6:
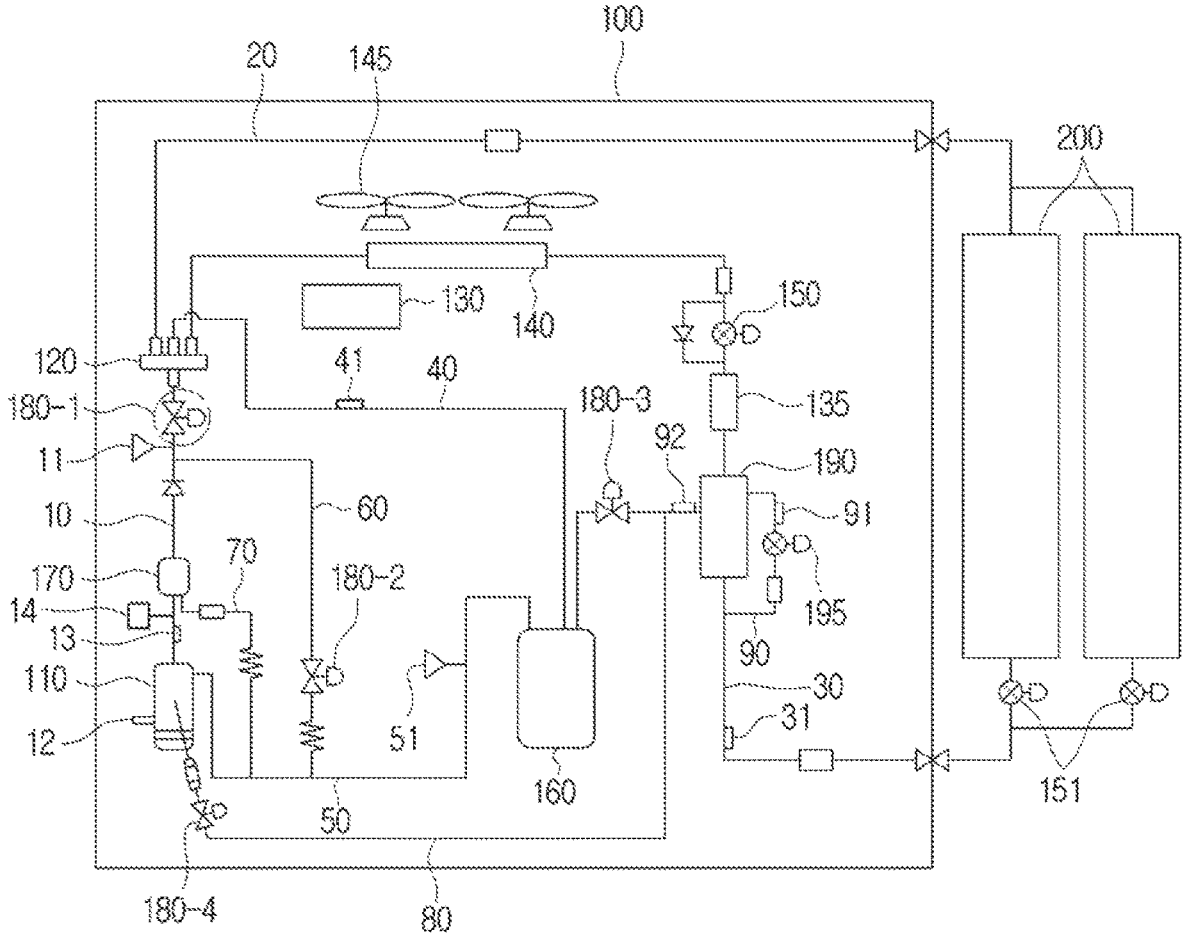
FIG. 6 is a diagram illustrating a cycle circuit of the air conditioner system according to an embodiment of the disclosure in more detail.

FIG. 6 is a diagram illustrating a cycle circuit of the air conditioner system 100 according to an embodiment of the disclosure in more detail.

Referring to FIG. 6, the air conditioner system 100 may further include at least one of a pressure switch 14, an intelligent power module (IPM) 135, a double pipe heat exchanger 190, or an expansion valve 195 for a double pipe heat exchanger, in addition to the above-described components. Also, the air conditioner system 100 may further include pipe lines 80 and 90 for connecting the pressure switch 14, the intelligent power module (IPM) 135, the double pipe heat exchanger 190, and the expansion valve 195 for a double pipe heat exchanger to the heat exchanger 140, the liquid separator 160, and the indoor unit 200.

The pressure switch 14, which is a component for protecting the compressor 110 and the pipe line, is configured to lower a discharge pressure of the compressor 110 when the pressure is too high and increase the pressure when the pressure is too low.

The IPM 135, which is a component for driving the compressor 110, the fan 145, and the like, may include an inverter for converting an electric signal. When the IPM 135 is disposed between the heat exchanger 140 and the indoor unit 200 as illustrated in FIG. 6, the IPM 135 may be cooled by the flowing refrigerant.

The double pipe heat exchanger 190 and the expansion valve 195 for a double pipe heat exchanger are components for various purposes, for example, increasing an amount of oil in the compressor 110 and energy efficiency, increasing an amount of heat exchanged between indoor air and refrigerant in the indoor unit 200 in the cooling mode, and preventing the refrigerant from being evaporated before reaching the indoor unit 200 in the cooling mode.

Specifically, the refrigerant is expanded after partially flowing into the expansion valve 195 for a double pipe heat exchanger via the pipe line 30 and a low-temperature refrigerant is obtained. The refrigerant flowing in the double pipe heat exchanger 190 via the pipe line 30 and the obtained low-temperature refrigerant flow via different pipes that are adjacent to but separate from each other. As a result, heat exchange may be performed therebetween.

Referring to FIG. 6, the air conditioner system 100 may further include a temperature sensor 31 for checking a condensed degree of the refrigerant and the like, and a temperature sensor 41 for calculating a superheat degree of the gas-state refrigerant sucked into the compressor 110, temperature sensors 91 and 92 for identifying a degree of heat exchange in the double pipe heat exchanger 190 as a condition for controlling a refrigerant expanding degree of the expansion valve 195 for a double pipe heat exchanger, and the like as well.

In addition, the air conditioner system 100 may further include valves 180-3 and 180-4 for opening/closing the pipe lines 80 and 90.

Meanwhile, in addition to the above-described embodiments, two additional embodiments for efficiently using the refrigerant blocked by the blocking valve 180-1 will be described with reference to FIGS. 7 and 8.

Figure 7:
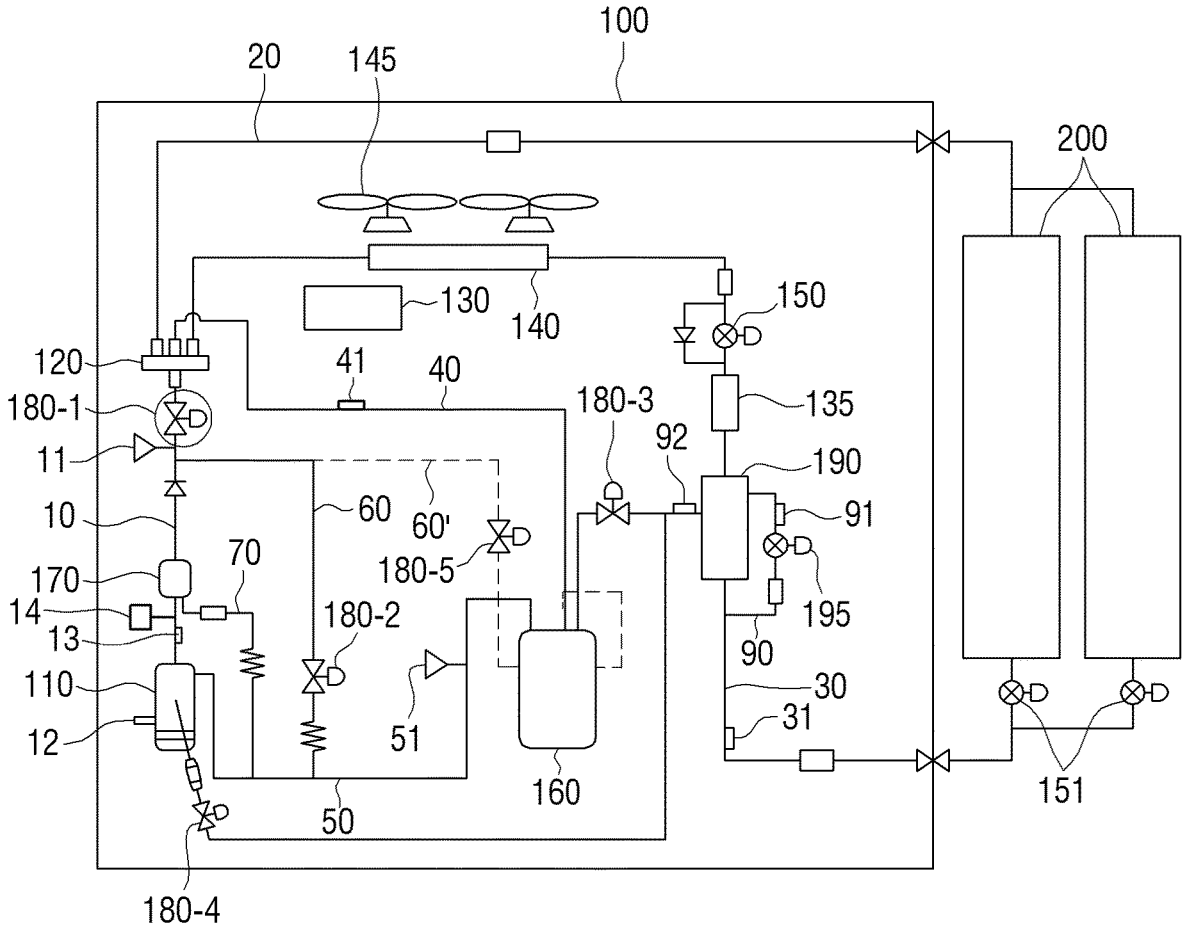
FIG. 7 is a diagram for explaining an example of a cycle circuit for using a refrigerant blocked by the blocking valve to increase a temperature of a liquid separator.

FIG. 7 is a diagram for explaining an example of a cycle circuit for using the refrigerant blocked by the blocking valve 180-1 to increase a temperature of the liquid separator 160.

Referring to FIG. 7, the air conditioner system 100 may further include a first line 60' connecting the circulation line 60 and the inlet port of the liquid separator 160, while surrounding an external surface of the liquid separator 160.

At this time, the controller 130 may increase the temperature of the liquid separator 160 by opening a valve 180-5 disposed in the first line 60' in a state in which the blocking valve 180-1 is closed. As a result, an amount of the liquid-state refrigerant in the liquid separator 160 may be reduced. This may be helpful in preventing a situation in which the liquid separator 160 is filled with liquid refrigerant therein, and thus, the liquid refrigerant as well as oil and gas refrigerants is introduced into the compressor 110.

Figure 8:
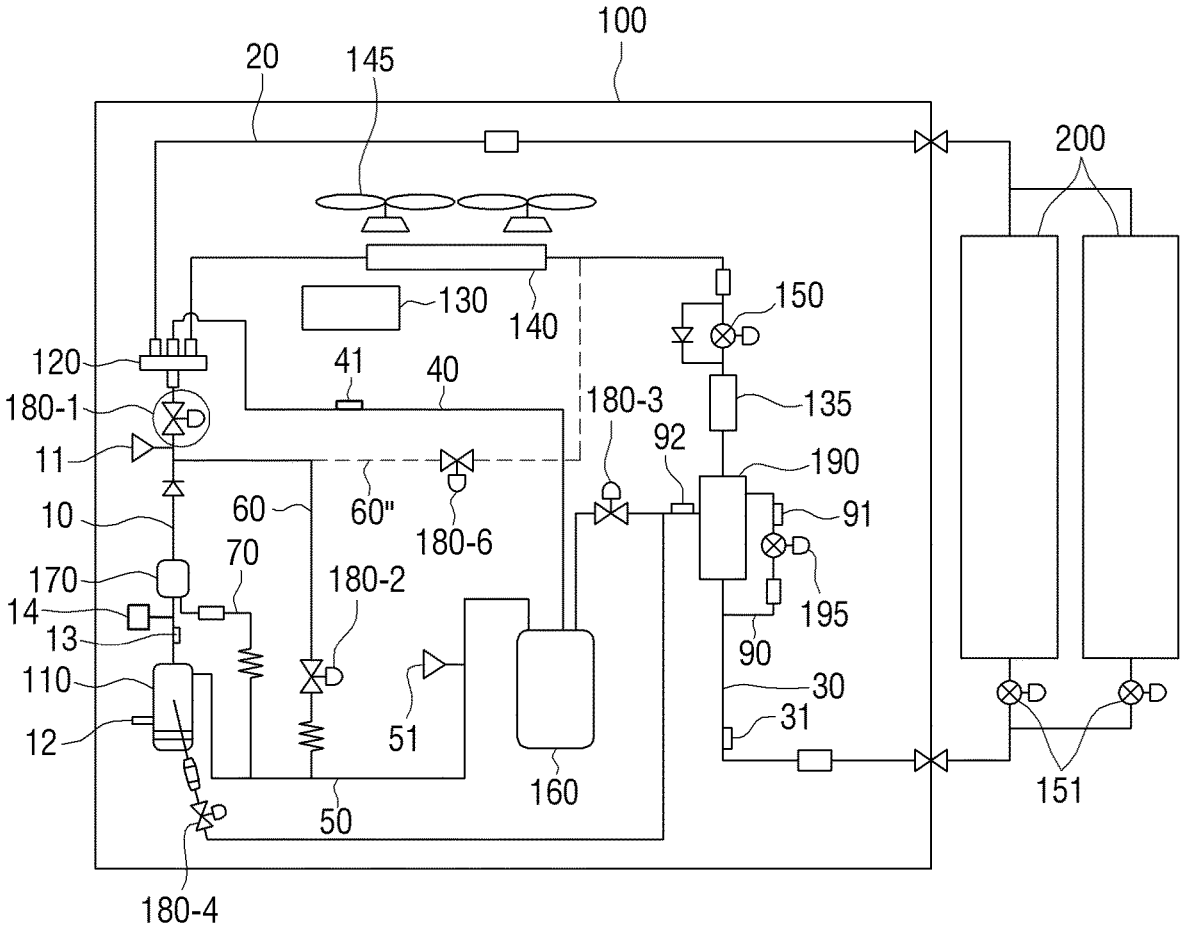
FIG. 8 is a diagram for explaining an example of a cycle circuit for using a refrigerant blocked by the blocking valve to increase a temperature of a heat exchanger.

FIG. 8 is a diagram for explaining an example of a cycle circuit for using the refrigerant blocked by the blocking valve 180-1 to increase a temperature of the heat exchanger 140.

Referring to FIG. 8, the air conditioner system 100 may further include a second line 60" connecting the circulation line 60 and the heat exchanger 140. Specifically, the second line 60" may be connected to an outlet of the heat exchanger 140 on the basis of the cycle in the cooling mode.

At this time, the controller 130 may open a valve 180-6 disposed in the second line 60" in a state in which the blocking valve 180-1 is closed. As a result, in the heating mode, the refrigerant discharged from the compressor 110 may circulate to be returned to the inlet port of the compressor 110 through the heat exchanger 140 (via the four-way valve 120 and the liquid separator 160).

In this case, the temperature of the heat exchanger 140 is increased until an oil recovery rate of the compressor 110 is stabilized, thereby removing a residual frost of the heat exchanger 140, and delaying impregnation of the heat exchanger 140 with oil therein after the blocking valve 180-1 is opened.

The air conditioner system according to the disclosure is capable of blocking the refrigerant having passed through the compressor (and the oil separator) not to immediately flow into the pipe connected to the heat exchanger or the indoor unit, when the refrigerant discharged from the compressor contains a large amount of oil and/or when the separation efficiency of the oil separator is not good.

As a result, the air conditioner system according to the disclosure may minimize additional injection of the refrigerant and the resultant deterioration in energy efficiency.

Meanwhile, the various embodiments described above may be implemented through a recording medium that is readable by a computer or a similar device by using software, hardware, or a combination thereof.

For hardware implementation, the embodiments described in the disclosure may be implemented using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, micro-processors, or other electrical units for performing functions.

In some cases, the embodiments described in the specification may be implemented by a processor (not shown) itself. For software implementation, the embodiments, such as procedures and functions, described in the specification may be implemented by separate software modules. Each of the software modules may perform one or more functions or operations described in the specification.

Meanwhile, computer instructions for performing processing operations of the air conditioner system 100 according to the various embodiments of the disclosure described above may be stored in a non-transitory computer-readable recording medium. The computer instructions stored in the non-transitory computer-readable medium may cause a specific device to perform the processing operations of the air conditioner system 100 according to the various embodiments described above when executed by a processor of the specific device.

The non-transitory computer-readable medium refers to a medium that stores data semi-permanently, rather than storing data for a short time, such as a register, a cache, or a memory, and is readable by an apparatus. Specifically, the above-described various applications or programs may be stored and provided in a non-transitory computer-readable medium such as a compact disc (CD), a digital versatile disk (DVD), a hard disk, a Blu-ray disk, a universal serial bus (USB), a memory card, or a ROM.

In addition, although the preferable embodiments of the disclosure have been illustrated and described hereinabove, the disclosure is not limited to the specific embodiments as described above, and may be variously modified by those skilled in the art to which the disclosure pertains without departing from the gist of the disclosure as claimed in the appended claims. Such modifications should not be individually understood from the technical spirit or prospect of the disclosure.

What is claimed is:

1. An air conditioner system, comprising:

a compressor;

a four-way valve configured to provide a refrigerant circulation path depending on an operation mode of the air conditioner system;

an oil separator disposed between the compressor and the four-way valve;

a pressure sensor configured to detect a pressure of the refrigerant passing through the oil separator after being discharged from the compressor;

a first temperature sensor configured to detect a temperature of the compressor;

a second temperature sensor configured to detect a discharge temperature of the compressor;

a blocking valve, disposed between the oil separator and the four-way valve, having an opened state in which the refrigerant passing through the oil separator after being discharged from the compressor passes through the blocking valve to the four-way valve and a closed state in which the refrigerant passing through the oil separator after being discharged from the compressor is blocked by the blocking valve from passing to the four-way valve;

a circulation line having an input end downstream of the oil separator and upstream of the blocking valve, the circulation line configured to provide a path for introducing the refrigerant passing through the oil separator after being discharged from the compressor into the input end and then back into the compressor when the blocking valve is in the closed state; and a controller configured to control the blocking valve to be in the opened state or the closed state, and when the temperature of the compressor detected by the first temperature sensor is higher than a saturation temperature corresponding to the pressure of the refrigerant passing through the oil separator after being discharged from the compressor detected by the pressure sensor by a predetermined first value or more, identify whether the discharge temperature of the compressor detected by the second temperature sensor is higher than the saturation temperature corresponding to the pressure of the refrigerant passing through the oil separator after being discharged from the compressor detected by the pressure sensor by a predetermined second value or more, and when the discharge temperature of the compressor is identified to be higher than the saturation temperature corresponding to the pressure of the refrigerant passing through the oil separator after being discharged from the compressor detected by the pressure sensor by the predetermined second value or more, control the blocking valve to be in the opened state.

2. The air conditioner system as claimed in claim 1, wherein the controller is configured to control the blocking valve to be in the closed state once the air conditioner system starts to operate.

3. The air conditioner system as claimed in claim 1, further comprising:

a valve disposed in the circulation line; and an oil return line configured to return oil separated by the oil separator from the refrigerant discharged from the compressor to an inlet port of the compressor, wherein the controller is configured to open the valve disposed in the circulation line when an amount of the oil in the oil return line is smaller than a predetermined amount and a pressure at the inlet port of the compressor is lower than a predetermined pressure.

4. The air conditioner system as claimed in claim 1, wherein the controller is configured to lower an operating frequency of the compressor when a difference between the pressure of the refrigerant discharged from the compressor and a pressure at an inlet port of the compressor is greater than or equal to a predetermined value.

5. The air conditioner system as claimed in claim 1, further comprising:

a liquid separator connected to the four-way valve and an inlet port of the compressor; and a line configured to connect the circulation line and an inlet port of the liquid separator, while surrounding an external surface of the liquid separator; and a valve disposed in the line configured to connect the circulation line and the inlet port of the liquid separator, wherein the controller is configured to open the valve disposed in the line configured to connect the circulation line and the inlet port of the liquid separator in a state in which the blocking valve is in the closed state.

6. The air conditioner system as claimed in claim 1, further comprising:

a heat exchanger;

a line configured to connect the circulation line and the heat exchanger; and a valve disposed in the line configured to connect the circulation line and the heat exchanger, wherein the controller is configured to open the valve disposed in the line configured to connect the circulation line and the heat exchanger in a state in which the blocking valve is in the closed state.

7. An air conditioner system comprising:

a compressor;

a four-way valve;

an oil separator disposed between the compressor and the four-way valve;

a pressure sensor configured to detect a pressure of a refrigerant passing through the oil separator after being discharged from the compressor;

a first temperature sensor configured to detect a temperature of the compressor;

a second temperature sensor configured to detect a discharge temperature of the compressor;

a blocking valve, disposed between the oil separator and the four-way valve, having an opened state in which the refrigerant passing through the oil separator after being discharged from the compressor passes through the blocking valve to the four-way valve and a closed state in which the refrigerant passing through the oil separator after being discharged from the compressor is blocked by the blocking valve from passing to the four-way valve;

a circulation line having an input end downstream of the oil separator and upstream of the blocking valve, the circulation line configured to, when the blocking valve is in the closed state, provide a path for introducing the refrigerant passing through the oil separator after being discharged from the compressor into the input end and then back into the compressor;

a heat exchanger;

a liquid separator; and a controller configured to:

when the air conditioner system is started in a heating mode, control the blocking valve to be in the closed state at a time when the compressor is started or within a predetermined time from the time when the compressor is started, control the four-way valve to set a refrigerant path in which the refrigerant passing through the oil separator after being discharged from the compressor is introducible into the four-way valve, to then travel through the indoor unit to the heat exchanger, to then travel through the four-way valve, and to then travel through the liquid separator to the compressor, when the temperature of the compressor detected by the first temperature sensor is higher than a saturation temperature corresponding to the pressure of the refrigerant passing through the oil separator after being discharged from the compressor detected by the pressure sensor by a predetermined first value or more, identify whether the discharge temperature of the compressor detected by the second temperature sensor is higher than the saturation temperature corresponding to the pressure of the refrigerant passing through the oil separator after being discharged from the compressor detected by the pressure sensor by a predetermined second value or more, and when the discharge temperature of the compressor is identified to be higher than the saturation temperature corresponding to the pressure of the refrigerant passing through the oil separator after being discharged from the compressor detected by the pressure sensor by the predetermined second value or more, control the blocking valve to change from the closed state to be in the opened state, when the air conditioner is started in a cooling mode, control the four-way valve to set a refrigerant path in which the refrigerant passing through the oil separator after being discharged from the compressor is introducible into the four-way valve, to then travel through the heat exchanger to the indoor unit, to then travel through the four-way valve, and to then travel through the liquid separator to the compressor, and control the blocking valve to be in the opened state.

8. The air conditioner system as claimed in claim 7, further comprising:

a valve disposed in the circulation line; and an oil return line configured to return oil separated by the oil separator from the refrigerant discharged from the compressor to an inlet port of the compressor, wherein the controller is configured to open the valve disposed in the circulation line when an amount of the oil in the oil return line is smaller than a predetermined amount and a pressure at the inlet port of the compressor is lower than a predetermined pressure.

9. The air conditioner system as claimed in claim 7, wherein the controller is configured to control the blocking valve to be in the opened state when a pressure at an inlet port of the compressor is higher than a predetermined pressure.

10. The air conditioner system as claimed in claim 7, wherein the controller is configured to lower an operating frequency of the compressor when a difference between the pressure of the refrigerant discharged from the compressor and a pressure at an inlet port of the compressor is greater than or equal to a predetermined value.

11. The air conditioner system as claimed in claim 7, further comprising:

a line configured to connect the circulation line and an inlet port of the liquid separator, while surrounding an external surface of the liquid separator; and a valve disposed in the line configured to connect the circulation line and the inlet port of the liquid separator, wherein the controller is configured to open the valve disposed in the line configured to connect the circulation line and the inlet port of the liquid separator in a state in which the blocking valve is in the closed state.

12. The air conditioner system as claimed in claim 7, further comprising:

a line configured to connect the circulation line and the heat exchanger; and a valve disposed in the line configured to connect the circulation line and the heat exchanger, wherein the controller is configured to open the valve disposed in the line configured to connect the circulation line and the heat exchanger in a state in which the blocking valve is in the closed state.

* * * * *